United States Patent [19]

Choi et al.

[11] Patent Number: 4,832,699

[45] Date of Patent: May 23, 1989

[54] CONTINUOUS PROCESS FOR DYEING NYLON FABRICS

[75] Inventors: M. K. Choi, Jamestown; Ernest J. Russell, Greensboro, both of N.C.

[73] Assignee: Burlington Industries, Inc., Greensboro, N.C.

[21] Appl. No.: 134,071

[22] Filed: Dec. 17, 1987

Related U.S. Application Data

[63] Continuation-in-part of Ser. No. 73,481, Jul. 15, 1987.

[51] Int. Cl.[4] ..... C09B 29/00

[52] U.S. Cl. ..... 8/680; 8/611; 8/924

[58] Field of Search ..... 8/476, 493, 680

[56] References Cited

U.S. PATENT DOCUMENTS 3,433,008 3/1969 Gage ..... 264/130

OTHER PUBLICATIONS

DuPont Product Brochure, Dec. 1981—No. 432: "Processing Cordura® Type 440 Nylon in Dyed Broad-woven Fabrics for Leisure End-Uses".

*Primary Examiner*—A. Lionel Clingman

*Attorney, Agent, or Firm*—Nixon & Vanderhye

[57] ABSTRACT

Filament nylon 6 and 66 fabrics are dyed in a multi-step continuous aqueous dyeing process. Uniformly dyed fabrics having a high degree of fiber bundle penetration result.

11 Claims, No Drawings

CONTINUOUS PROCESS FOR DYEING NYLON FABRICS

CROSS REFERENCE TO RELATED APPLICATIONS

This application is a continuation-in-part of our earlier application Ser. No. 073,481 filed July 15, 1987.

Nylon fabrics are dyed in a multi-step continuous aqueous dyeing process. Uniformly dyed fabrics having a high degree of fiber bundle penetration result.

BACKGROUND OF THE INVENTION

Dyeing of filament nylon fabrics is conventionally performed by batch processes or on a jig, which may be considered a semi-continuous process. Attempts to dye filament nylon fabrics by conventional continuous processes result in intolerable variations in color from place to place, from side to side, from front to back, or from end to end of the fabric. The problems of non-uniformity are sufficiently severe so that filament nylon fabrics are not dyed continuously on a commercial basis.

The process of this invention, which may be conducted on a continuous dyeing range, employs a dye assistant system to effectively and uniformly dye filament nylon fabrics and low-denier, high-tenacity continuous filament fabrics. This continuous process uses an aqueous-based, homogeneous system and produces uniform, non-striated, dyed filament nylon with exceptional fiber bunder penetration. The process is more economical than conventional batch dyeing apparatus and uses commercially available range equipment. The process is continuous and the dyed fabric is of a more uniform quality, including a non-striated appearance with well-penetrated yarn bundles, from end to end and piece to piece as compared with fabrics dyed using the conventional batch procedure. The process of the invention successfully dyes normal tenacity continuous filament nylon 6 and nylon 66 as well as high tenacity nylon fabrics made from nylon yarns with a low denier per filament, i.e., a low filament diameter.

As used in this disclosure, the term high-tenacity nylon refers to fibeers of a high tensile strength nylon yarn having a low filament diameter spun from poly(-hexamethyleneadipamide), or 6,6 nylon, which has a draw ratio of at least 4.0, and preferably in the range of 4.6 to 5.1 Such fibers are disclosed in U.S. Pat. No. 3,433,008 to Gage, and are currently commercially available from various sources including Cordura® from DuPont, Wilmington, Del. These fibers are used to make fabrics which are in turn formed into long-wearing, abrasion-resistant articles of clothing, suitcase and handbag material, antiballistic clothing and protective devices and similar articles.

The currently preferred Cordura® product contains approximately twice as many amino end-groups as conventional nylon. The presence of these end-groups favours undesirable ring dyeing of the fabric, and makes uniform dyeing and complete penetration of the yarn bundle difficult in a continuous process. Ballistic nylons and other high-tenacity nylon products may not contain an unusually high content of amine end-groups as does Cordura®, but they are also easily dyed by the process of this invention if their denier per filament is low.

DETAILED DESCRIPTION OF THE INVENTION

In the outline form, the process of this invention comprises the following steps:

1. Padding with a dyebath containing the following ingredients:
   a. An acid dyestuff, preferably but not necessarily monosulfonic
   b. A wetting agent and penetrant such as dioctylsulfosuccinic acid sodium salt
   c. An anti-migrant such as sodium alginate or polyacrylic acid
   d. A two-component dye transport system, including a retarding/leveling agent such as Cenegen 7 (Crompton and Knowles), and a glycol such as diethylene glycol
2. Preliminary drying to reduce migration of the dyebath components
3. Thermofixation in a conventional curing oven
4. Washing of the thermofixed fabric by conventional means.

Described is a process for uniformly continuously dyeing continuous filament nylon fabrics. An aqueous dyebath containing a tinctorial amount of an acid dyestuff, preferably a monosulfonic acid dye, and a dye transport system active at elevated temperatures is applied to the fabric in open width. The continuous process uses typical acid dyes, a dye penetrant, an antimigrant, a water-miscible high temperature fluid, and a dye rate retarding agent. The dyebath solution is placed in a low volume dye pad system. The fabric being processed is quickly immersed in the dye bath solution and then squeezed to a controlled wet pick-up. The short contact time of the fabric with the dye liquor reduces the potential of tailing due to the different adsorption rates of the dyes onto the fabric. The rate-reducing agent generally absorbs at the periphery of the filament bundle, occupying the adsorption area available for dyes. This provides the opportunity for the dyes adsorbed at the periphery to diffuse into the core of the filament bundle at a controlled rate, driven by heat energy in the thermofixation step. The dye transport system is composed of a retarding and leveling agent volatile at elevated temperatures to facilitate rapid penetration of the nylon filament bundles and mono-, di-, tri- or other ($C_1$–$C_4$) alkylene glycols having a molecular weight in the range of about 50 to about 200.

The dyed fabric is preliminarily dried at a controlled rate to reduce migration of the dyebath liquid on the fiber, to heat activate the dye transport system and promote uniform penetration of the filament bundle. It is important to dry the fabric at a relatively low temperature such that the high-temperature fluid can remain at the core of the filament bundles and act as a dye transport medium, thus further enhancing the uniform distribution of dyes in the filament core.

The dried fabric is thermofixed at elevated temperatures—this causes the dyestuff to penetrate into the fibers and to volatilize the retarding and levelinga agent. During the thermofixation step the dyes can penetrate into the individual fibers by means of thermal energy and the fixation of dyes is completed. During the thermal exposure, the rate-retarding agent generally adsorbed at the periphery of the filament bundle is released due to heat. This allows the dyes in the vicinity to occupy the released sites. The presence of a thin layer of high-temperature fluid at the surface of the fibers facilitates the dye transport into the fiber. The fabric is stabilized by mechanical means (pins and clips) so that width dimension can be controlled. Typical equipment for thermofixation step is a tenter frame. Any unattached dye or any remaining processing agents are removed by washing in a series of wash boxes and drying in conventional manner.

Dyebath—an aqueous dyebath suitable for use on a continuous pad system is prepared and contains several of the following ingredients: an acid dyestuff, preferably but not necessarily monosulfonic and a wetting agent serving the dual function of a wetting agent and a penetrant. Dioctylsulfosuccinic acid sodium salt is quite suited to this use. Included also is an antimigrant to prevent migration of dye on the fabric prior to fixation; sodium alginate is a preferred antimigrant, although synthetic antimigrants such as dry polyacrylic acid resins may also be useful to prevent migration.

The dyebath also includes a two-component dye transport system which is active at high temperatures and facilitates heretofore unobserved rapid penetration of the fiber in filament bundles. The dye transport system includes a retarding/leveling agent acting as a colorless dye in the earlier stages of the dyeing process, but which volatilizes at high temperatures during later stages of the processing. This component minimizes the initial rapid fixation tendency of dyes on nylon fiber surfaces, which leads to undesirable ring dyeing or poor filament bundle penetration. The preferred retarding-/leveling aggent is Cenegen 7 (Crompton & Knowles) an alkaryl ether sulfonate derivative, anionic in nature and water miscible. Other retarding/leveling agents to be considered included Cenegen B (alkyl ether salts, ampholytic, water miscible) Cenegen BP (alkylaryl sulfo derivative, anionic, water miscible), and Cenekol 1141 (sulfonated phenolic condensate, anionic, water miscible) all from Crompton & Knowles Corporation; Irgalev PBF anionic alkyl diphenyl-ether derivative, (an anionic leveling agent for nylon, water dilutable) from Ciba-Geigy Corporation; Alkanol WXN (sodium alkyl benzene sulfonate, a surfactant completely miscible with water) and Alkanol ND (sodium alkyl diaryl sulfonate, a dyeing assistant) both from DuPont; and Chemcogen AC (Lyndal Chemical Company). The second component of the dye transport system is a glycol, especially diethylene glycol, which remains in the fabric even at high temperatures. Diethylene glycol (DEG) is preferred since we have found it to be more effective than the glycol ethers or other glycols, such as triethylene glycol. Other additives and adjuvants may be added to the dyebath as required.

Application—the dyebath described above is applied to the nylon fabric using any convenient application means. We prefer to use a pad bath operating at a minimum volume level. The pad operator is able to effectively control the amount of dyebath applied to the fabric calculated as percentage of wet pick-up with a pair of squeeze or nip rolls pressing the fabric as it emerges from the pad bath. The tendency of the fabric to present differential shading from end to end, i.e., "tailing", is significantly reduced by the action of the retarder/leveler, as well as by reduced exposure times in the pad bath. Applying the dyebath in a pad permits operation within wide variations and allows the operator an added degree of flexibility in this continuous process.

Preliminary Drying—the fabric emerging from the pad is at least partially dried to a level sufficient to reduce migration of the dyebath. It is at this point that the dye transport system, as detailed above, becomes active and, although not wishing to be bound to any particular theory, we believe the retarding/leveling agent temporarily occupies the dye sites of the outer shell filaments in the nylon bundle while the diethylene glycol assists the dye to diffuse among the inner filaments at a uniform rate. In this manner both components work together to enhance uniform penetration of the filament bundle. These procedures also improve the appearance of the total fabric through a less competitive dye-to-dyesite mechanism.

Thermofixation Treatment—the fabric then passes through a conventional curing oven where thermal energy aids to further penetrate the dyes into the filaments. The dye fixation to the filaments is initiated due to the volatization of the retarding/leveling agent and almost simultaneous adsorption of the surrounding dye. The diethylene glycol at the surface of the fibers facilitates dye transport into the fiber.

Washing/Drying—the dyed fabric is then subjected to the usual washing and drying operations as is conventional and is ready for chemical finishing operations, garmet construction, etc.

The process of the invention is illustrated by the following examples in which all parts and percentages are expressed by weight unless otherwise indicated.

EXAMPLE I

A pilot scale trial was conducted, using the following navy blue dyebath:

| | |
|---|---|
| 20.0 g/L | Intrazone Fast Blue 5R 175% (Acid Blue 113 - 26360) |
| 2.2 g/L | Tectilon Yellow 4R k 250% (Acid Yellow 219) |
| 7.5 g/L | Intraphasol COP |
| 20.0 g/L | Diethylene glycol |
| 20.0 g/L | Benzyl alcohol |
| 20.0 g/L | Cenegen 7 |
| 30.0 g/L | Antimigrant B |

The bath was padded onto a plain weave nylon shell fabric made from 200/32 nylon 6 (made by Allied Corporation), weighing 3.0 oz./sq. yd., at a wet pick-up of 30–35%. The dyebath was maintained at 130° F. Following padding, the fabric was dried by means of infrared preheating to minimize dye migration, followed by oven drying and steam can contact drying. Thermofixation was carried out in a conventional curing oven at a setting of 380° F. for 2.33 minutes.

The fabric then exited into a series of eight wash boxes, double laced. Wash boxes Nos. 1 and 2, which served for scouring, contained 4.0 g/L of a nonionic detergent and 5.0 g/L of sodium bicarbonate at 120° F. Wash boxes Nos. 3 through 8 served as final rinses at 180° F. before steam can drying at 30 psig steam pressure.

The nylon 6 fabric was dyed a navy blue shade with extremely good uniformity. No evidence of side-center-side, face-to-back, or end-to-end shading was found.

EXAMPLE II

A pilot scale trial was conducted, using the following khaki shade dyebath:

| | |
|---|---|
| 1.26 g/L | Tectilon Yellow 4R k 250% (Acid Yellow 219) |

-continued

| | |
|---|---|
| 2.24 g/L | Nylomine Red A-B (Acid Red 396) |
| 1.68 g/L | Nylanthrene Blue B-GA (Acid Blue) |
| 7.5 g/L | Intraphasol COP |
| 20.0 g/L | Benzyl alcohol |
| 20.0 g/L | Diethylene glycol |
| 30.0 g/L | Cenegen 7 |
| 30.0 g/L | Unipad B antimigrant |

The bath was padded onto a plain-weave nylon shell fabric made from 200/32 nylon 66 (made by DuPont), weighing 3.0 oz./sq. yd., at a wet pick-up of 30–35%. The dyebath was maintained at 130° F. Following padding, the fabric was dried by means of infrared preheating to minimize dye migration, following by oven drying and steam can drying. Thermofixation was carried out in a curing oven at 420° F. for 2.33 minutes. Washing and final drying were carried out as in Example I.

The nylon 66 fabric was dyed uniformly to a khaki shade, with no evidence of side-to-center, face-to-back, or end-to-end shading.

EXAMPLE III

A pilot scale trial was conducted, using the following olive green dyebath:

| | |
|---|---|
| 30.0 g/L | Tectilon Yellow 4R k 250% (Acid Yellow 219) |
| 25.0 g/L | Nylomine Red A-B (Acid Red 396) |
| 30.0 g/L | Nylanthrene Blue B-GA (Acid Blue) |
| 7.5 g/L | Intraphasol COP |
| 20.0 g/L | Benzyl alcohol |
| 20.0 g/L | Diethylene glycol |
| 20.0 g/L | Cenegen 7 |
| 30.0 g/L | Unipad B antimigrant |

The bath was padded onto a rip-stop nylon fabric made from 30/10 high-tenacity nylon 66 (made by DuPont), weighing 1.0 oz./sq. yd., at a wet pick-up of 37%. The dyebath was maintained at 130° F. Following padding, the fabric was dried by means of infrared preheating to minimize dye migration, followed by oven drying and steam can drying. Thermofixation was carried out in a curing oven at 420° F. for 1.75 minutes. Washing and final drying were carried out as in Example I.

The high-tenacity rip-stop fabric was dyed uniformly to an olive green shade, with no evidence of side-to-center, face-to-back, or end-to-end shading. Cross-sections were made of the dyed filaments, and penetration was found to be complete and uniform.

EXAMPLE IV

A pilot scale trial was conducted, using the following forest green dyebath:

| | |
|---|---|
| 4.8 g/L | Tectilon Yellow 4R k 250 (Acid Yellow 219) |
| 4.8 g/L | Nylomine Red A-B (Acid Red 396) |
| 22.5 g/L | Nylanthrene Blue B-GA (Acid Blue) |
| 7.5 g/L | Intraphasol COP |
| 20.0 g/L | Benzyl alcohol |
| 20.0 g/L | Diethylene glycol |
| 20.0 g/L | Cenegen 7 |
| 30.0 g/L | Unipad B antimigrant |

The bath was padded onto a rip-stop nylon fabric made from 30/10 high-tenacity nylon 66 (made by DuPont), weighing 1.0 oz./sq. yd., at a wet pick-up of 37%. The dyebath was maintained at 130° F. Following padding, the fabric was dried by means of infrared preheating to minimize dye migration, followed by oven drying and steam can drying. Thermofixation was carried out in a curing oven at 420° F. for 1.75 minutes. Washing and final drying were carried out as in Example I.

The high-tenacity rip-stop fabric was dyed uniformly to an forest green shade, with no evidence of side-to-center, face-to-back, or end-to-end shading. Cross-sections were made of the dyed filaments, and penetration was found to be complete and uniform.

The process of this invention dyes lightweight fabrics made from low-denier (less than 4 denier/filament) high-tenacity continuous filament yarn. Versatility in processing speed and equipment makes this process adaptable to typical wet continuous processing equipment. This process also applies to lightweight apparel nylon 66 or nylon 6 fabrics. Due to higher denier and heavier weights, longer exposure time in the processing steps may be required, if the denier/filament of the nylon is greater than about 6.

This process produces continuous filament nylon fabric with a good appearance and quality at high production speeds. Dyeing is carried out in a typical finishing range consisting of a finishing pad, as set of steam cans or infrared units, and a tenter frame (typically 120 ft. in length). The average processing speed can be in excess of 50 ypm.

What is claimed is:

1. A continuous process for uniformly dyeing continuous filament nylon fabrics comprising the successive steps of:

(1) applying to the nylon fabric in open width an aqueous dyebath containing a tinctorial amount of an acid dyestuff, a wetting agent and a dye transport system active at elevated temperatures and composed of (a) a retarding and leveling agent to facilitate rapid penetration of the nylon filament bundles and (b) a mono, di-, or tri-lower ($C_1$–$C_4$) alkylene glycol having a molecular weight in the range of about 50 to about 200;

(2) partially drying the dyed fabric of step (1) at a controlled rate and at a temperature lower than the thermofixing temperature to reduce migration of the dyebath liquid on the fiber, to heat-activate the dye transport system and promote uniform penetration of the filament bundle;

(3) thermofixing the treated fabric of step (2) at elevated temperatures from between about 375° and 450° F. to penetrate the dyestuff into the fibers (a); and thereafter (4) washing the fabric to remove any unattached dye and any remaining processing agents.

2. The process of claim 1 in which the nylon is high tenacity 6,6 yarn having a denier per filament of less than 4 and a draw ratio of about 4.6 to about 5.1.

3. The process of claim 1 in which the nylon is nylon 6 or nylon 66.

4. The process of claim 1 in which the aqueous dyebath is applied to the fabric in open width in a pad bath.

5. The process of claim 4 in which the aqueous dyebath is maintained at a temperature from ambient up to about 150° F.

6. The process of claim 5 in which the aqueous dyebath also includes an antimigrant.

7. The process of claim 5 in which the dye is a monosulfonic acid dye.

8. The process of claim 1 in which the fabric is dried in step (2) by infrared heaters.

9. The process of claim 1 in which the fabric is thermofixed in step (3) at a temperature of between about 375° F. and 450° F. for a period of from about 0.5 to about 3 minutes.

10. A continuously-dyed, nylon 6 or 66 fabric produced by the process of claim 1.

11. A continuously-dyed, high tenacity nylon 66 fabric produced by the process of claim 2.

* * * * *